United States Patent [19]

Wilson et al.

[11] Patent Number: 4,766,814

[45] Date of Patent: Aug. 30, 1988

[54] MATERIALS FOR THERMAL PROTECTION BY RAPID SMOKE PRODUCTION

[76] Inventors: Lloyd C. Wilson, 579 Wavell Ave., Ottawa, 13, Ontario; Patrick Cavanagh, 32 Gervin Cres., Ottawa SS. 12., Ontario, both of Canada

[21] Appl. No.: 333,758

[22] Filed: Dec. 26, 1963

[51] Int. Cl.[4] ..... F42B 13/44

[52] U.S. Cl. ..... 102/334; 89/36.01; 102/293; 428/247; 428/255; 250/515.1

[58] Field of Search ..... 102/90, 97, 334, 290, 102/293; 89/36, 36.01; 250/108, 108 FS, 515.1, 516.1; 161/89; 117/46 CA, 138.8 N; 428/247, 255

[56] References Cited

U.S. PATENT DOCUMENTS 3,107,573 10/1963 Butcher .
3,130,112 4/1964 Anderson, Jr. .

*Primary Examiner*—Harold J. Tudor
*Attorney, Agent, or Firm*—Anthony T. Lane; Robert P. Gibson; Edward Goldberg

[57] ABSTRACT

This invention relates to a device for protection from the heat flash of atomic weapons. The invention comprises a nylon net coated with a mixture of neoprene and at least one explosive initiator selected from the group consisting of tetracene, lead styphnate and silver fulminate.

11 Claims, No Drawings

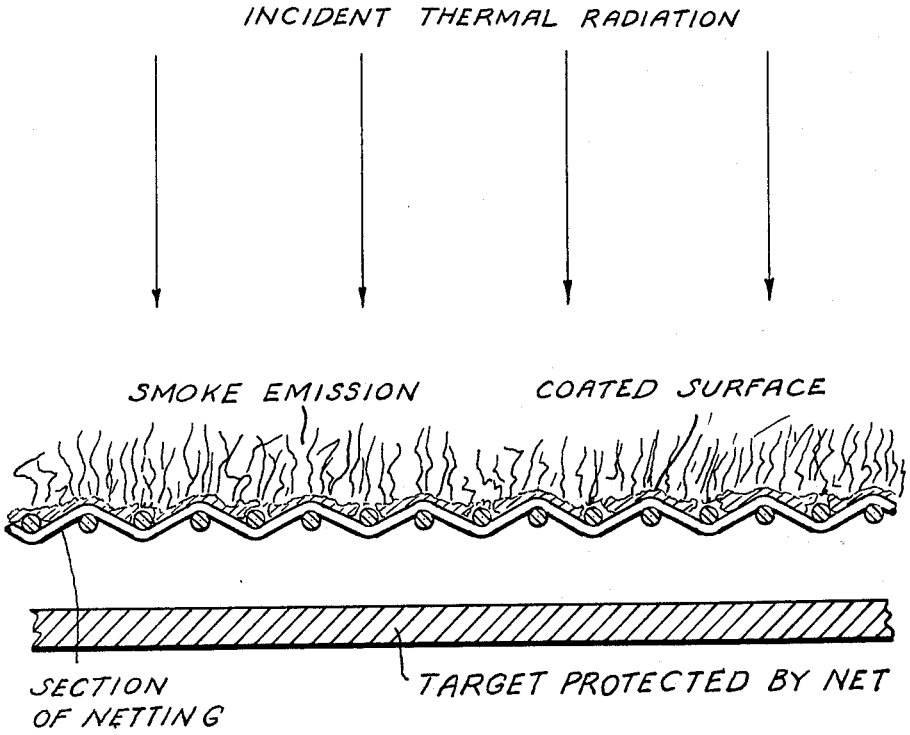
INCIDENT THERMAL RADIATION
SMOKE EMISSION
COATED SURFACE
SECTION OF NETTING
TARGET PROTECTED BY NET

MATERIALS FOR THERMAL PROTECTION BY RAPID SMOKE PRODUCTION

This invention relates to a device for protection from the heat flash of atomic weapons. It is intended particularly for the protection of personnel.

Since atomic weapons are quickly becoming an integral part of modern arsenals, considerable attention is being directed to the problem of protection from the heat flash of these weapons. The nature of the thermal hazard varies greatly with the yield of the weapon. Atomic weapons vary in size from a fraction of a kiloton to as much as 50 to 100 megatons. For the small weapons of less than 1 kiloton the thermal hazard zone is inside the lethal zone for ionizing radiations, so that at present thermal protection is of little importance. For the larger weapons, protection from thermal flash becomes increasingly important, but also the total time over which the thermal radiation energy is delivered becomes long enough for various simple methods of defense to be applied, e.g. taking cover.

Some weapons, however, present a thermal hazard over times too short for any conscious action to be of use, so that some type of constant protection is necessary. For personnel, particularly combat personnel, the usual aim has been to try to improve considerably the refractory qualities of clothing so that it can withstand the thermal radiation, without changing its normal wearing characteristics.

Test work has already been done in the United States on smoking paints for protecting property against thermal radiation. The smoking was initiated by the use of an explosive initiator which was incorporated into the paint. The explosive initiator e.g. tetracene, reacted instantaneously on being subjected to thermal radiation so as to initiate an almost instant production of smoke which in turn absorbed or dispersed the heat. The increase in protection achieved by this system was only marginal.

It was the purpose of the present development to produce a similar type of coating material for clothing. Initial tests were directed to determining what were the most effective initiators and fuels for the production of smoke. For this type of protection to be effective the smoke must be produced and formed into a sceen in front of the article to be protected within less than 0.1 seconds of the arrival of the beginning of the heat flash. The heat energy incident during this 0.1 second must raise the surface layers of the target to a high temperature, produce and eject a smoke of adequate density. It was found that the initiators which had been previously used for this purpose in the United States, i.e. common explosive initiators, were the most effective, the preferred ones being tetracene, lead styphnate and silver fulminate.

Tests were also conducted to obtain a satisfactory fuel. The function of the fuel is to provide a dense smoke when vaporized or burnt by the initiator. Numerous fuels were tested, such as anthracene, butyl cement, carbon, starch, sugar, ferrocene and neoprenes, most of which did produce dense smoke but by far the most effective one was found to be a neoprene cement. The compounded neoprene cements were surprisingly effective in producing a uniform, dense cloud of smoke which effectively absorbed or dispersed the heat. In view of these results the subsequent tests were conducted with neoprene cements as the fuel and tetracene as the initiator.

When an efficient combination of initiator and fuel had been determined, attention was directed to the problem of applying this material to clothing. As had been stated above, the main problem with protection of clothing is that the protective material which is added should interfere as little as possible with the normal functions of the clothing. With this in mind, the first experiments were conducted using commercial clothing fabrics embossed with small raised dots of the smoke producing mixture. The intention here was to avoid stiffening the fabric, to retain moisture vapor permeability by leaving a high percentage area unaffected and to improve, if possible, the abrasion properties. These features were thought to be particularly important for protecting personnel since a complete covering of the mixture would not only be uncomfortable to wear because it would stiffen the material, but would cause unacceptable heat stress, particularly at high work rates or under tropical conditions. A number of fabrics prepared in the above manner were exposed in a solar furnace and a considerable amount of protection was obtained. For example, a 5 oz. cotton fabric which would normally char to destruction at an intensity of 5 calories per sq. cm. delivered in 1 second remained undamaged at 6 calories per sq. cm. in 1 second when embossed. However, at higher energies the heat from the burning fuel and emitted vapors damaged the fabric between the dots so that even though the fabric under the dots was undamaged the material between them was seriously weakened.

Since the fabric under the raised dots was protected while the fabric between the dots was destroyed, it was decided to try to produce a separate protection garment which could be worn over regular clothing so that the protective material would be spaced from the fabric. The protective material would require some form of support, and as stated above, would necessarily have openings to permit air circulation. With this in mind a series of tests were conducted in a solar furnace with fabric nets coated with a mixture of neoprene and tetracene. These tests showed that such a coated net was extremely effective in protecting fabrics from destruction by thermal radiation and that by the proper selection of mesh size good ventilation could be obtained without damage of the fabric directly behind the opening in the net. This also permitted the use of a material for the net which was much less flammable than ordinary garment material.

Accordingly, the invention in its broadest aspect can be described as being a device for protection from thermal radiation which comprises a net coated with a mixture of neoprene, preferably a compounded neoprene cement, and an explosive initiator. To insure good protection the net should be made from a heat resistant material and nylon has been found to be highly satisfactory for this purpose. Other materials have been tested and have also been found to be satisfactory. The hole size of the coated net should preferably not be larger than 5 mm. to insure complete protection against radiation intensities up to 30 cal/cm$^2$. in a few seconds.

To produce the coated net of the invention a nylon net is preferably first completely coated with a compounded neoprene cement. This makes an ideal backing since it is totally compatible with the neoprene-tetracene mixture and has the additional qualities of being quite resistant to both heat and wear. One or more coatings of a neoprene-tetracene mixture are then applied to one surface of the neoprene-coated net. The neoprene-tetracene mixture should contain at least 6% by weight of tetracene and preferably about 8% based on the solid content.

The attached drawing is a schematic illustration of the relative positions of the incident thermal radiation, the protective net and the object protected. As can be seen from the drawing, the surface of the net facing the incident radiation is coated with the neoprene-initiator mixture and the smoke is emitted in the direction of the incident radiation.

The actual amount of neoprene-tetracene mixture to be applied to the net can vary greatly. It has been found that the rate of emission of smoke is dependent on the intensity of the radiation so that the actual thickness of the coating will be dependent on the anticipated intensity of radiation and the length of time which the coating is expected to be subjected to the radiation. For protection of inanimate objects which cannot take avoiding action it is probable that thicker coatings would be needed than for protection of personnel.

The sequence of events which occur during the smoke production is that first a small amount of the radiant energy is reflected without any resultant thermal stress, and since the neoprene-tetracene mixture is nearly black, being from 0.3 to 2.5 microns, this reflection is often only a very few percent. Next all of the remaining radiant energy is absorbed while penetrating a very small distance beneath the surface of the mixture. The resultant temperature rise explodes the initiator and burns the fuel. These reactions are exothermic and material is ejected and forms a smoke which scatters and absorbs the incoming radiant energy. During and following this period energy is transferred in all directions (but mostly in the direction opposite to that of the incident radiation) by mass transfer of gases, vapors or small pieces of material. Some mass transfer can, of course, occur back through the holes of the net but this is a relatively minor amount. The heat developed in the material of the net is conducted to the near surface and then transferred by conduction through the air to the target. A small amount of heat may be re-radiated at long wave lengths through the net holes or from the surface of the net facing the fabric being protected.

EXAMPLES

To test the protective nets of this invention a series of coating compounds were prepared as follows:

| Compound No. 1 | |
|---|---|
| Neoprene | 100.00 |
| Zinc Oxide | 10.00 |
| Magnesia | 10.00 |
| "Nonox WSP"[1] | 2.00 |
| "Calcene TM"[2] | 50.00 |
| "Hi Sil 233"[3] | 20.00 |
| Titanium Dioxide | 10.00 |
| Na 22 | 0.50 |

[1]"Nonox WSP" is the trade mark of Imperial Chemical Industries for an alkylated bis-phenol.
[2]"Calcene TM" is the trade mark of Columbia-Southern Chemical Corp. for fine particle, precipitated calcium carbonate pigment.
[3]"Hi Sil 233" is the trade mark of Columbia-Southern Chemical Corp. for hydrated silica.

| Compound No. 2 | |
|---|---|
| Compound 1 | 202.50 |
| "Chlorowax 70"[1] | 10.00 |
| Antimony Trioxide | 40.00 |

[1]"Chlorowax 70" is the trade mark of Diamond Alkali Co. for a chlorinated paraffin wax.

| Compound No. 3 | |
|---|---|
| Neoprene | 100.00 |
| Zinc Oxide | 10.00 |
| Magnesia | 10.00 |
| Symmetrical di-beta-naphthyl-para-phenylene diamine | 2.00 |
| Phenyl-B-naphthylamine | 2.00 |
| Na22 | 0.50 |

| Compound No. 4 | |
|---|---|
| Compound 3 | 124.50 |
| EPC Black | 25.00 |

| Compound No. 5 | |
|---|---|
| Compound 3 | 124.50 |
| "Mineralite 3X"[1] | 50.00 |
| "Chlorowax 70" | 10.00 |
| Antimony Trioxide | 40.00 |

[1]"Mineralite 3X" is the trade mark of Mineralite Sales Corp.for a mica-type filler.

These compounds were then used for preparing coating solutions. To coat the nets they were dipped in a xylene solution of one of the above compounds and cured by heating. The nets were dipped several times in the solution, the number of dips being determined by the thickness of coating desired. The final coating layer was produced from a xylene solution of one of the above compounds to which was added 8 parts of tetracene per 100 parts solids.

TABLE I

Details of the smoke-producing nets used in Examples 1–13

| Final Net No. | Base Net Type | Base Coat | Base Coat Cure | Layer 1 | Layer 2 | Final Cure | Sq. Yd. Wt. |
|---|---|---|---|---|---|---|---|
| PN1 | Type A | No. 1 15% solids Dips - 4 | 30 mins. at 250° F. | No. 4 20% solids | No. 4 + Tetracene 20% solids | No. 4 | 17.9 |
| PN2 | Type B | No. 1 15% solids Dips - 4 | 30 mins. at 250° F. | No. 4 20% solids | No. 4 + Tetracene 20% solids | — | 20.2 |
| PN3 | Type B | No. 2 15% solids Dips - 4 | 30 mins. at 250° F. | No. 4(a) 15% solids | No. 4(a) + Tetracene 15% solids | — | 18.5 |
| PN4 | Type B | No. 2 | 30 mins. | No. 4(a) + | | | |

TABLE I-continued

Details of the smoke-producing nets used in Examples 1-13

| Final Net No. | Base Net Type | Base Coat | Base Coat Cure | Layer 1 | Layer 2 | Final Cure | Sq. Yd. Wt. |
|---|---|---|---|---|---|---|---|
| | | 15% solids | at 250° F. | Tetracene 15% solids | — | — | 11.9 |
| PN5 | Type B | No. 5 Colored Olive Drab 20% solids | 60 mins. at 280° F. | No. 4(a) + Tetracene 15% solids | — | 60 mins. at 200° F. | 12.0 |
| PN6 | Type B | No. 5 Colored Olive Drab 20% solids | 60 mins. at 280° F. | No. 3(a) Colored Olive Drab + Tetracene 15% solids | — | 60 mins. at 200° F. | 11.1 |
| PN7 | Type B | No. 5 Colored Olive Drab 20% solids | 60 mins. at 280° F. | No. 4(a) + Tetracene 15% solids | — | 60 mins. at 200° F. | 13.5 |

The designation (a) after the compound number indicates that an accelerator was added to the solution in an amount of 8 parts per 100 parts solids.

Two types of nylon net were used and these will be designated hereinafter as Type A and Type B.

Type A is a 100% nylon net of 4 oz/yd$^2$ with a hole size of approximately 4 mm, about 6 holes per inch in warp direction and 4 holes per inch in weft direction.

Type B is 100% nylon, 5 oz/sq. yd., hole size 2 mms., 6 holes warpways and 10 holes weftways.

Details of a series of nets which were coated in the above manner are described in Table I and these nets were used as the protective nets in the following tests.

EXAMPLE I

A sample of 13 oz./yd$^2$ Khaki colored all wool battle dress serge was subject without any protection to an exposure intensity of 8 cal/cm$^2$ in 1 second in a solar furnace. After the exposure the fabric was visibly charred and it had no appreciable bursting strength.

EXAMPLE 2

Example I was repeated at an exposure intensity of 20 cal/cm$^2$ with protective net PN 1 as described in Table I in front of and in contact with the fabric. Even though the intensity of the radiation was 2½ times the intensity in Example I, the fabric was only very slightly singed and the bursting strength was reduced by only about 10%.

EXAMPLE 3

Example 2 was repeated at an exposure intensity of 30 cal/cm$^2$ and in this case the fabric was singed in the pattern of the net and the bursting strength was reduced by about 25%.

EXAMPLE 4

Example 3 was next repeated using a different protective net, the net in this case being PN 2 which had a mesh opening of 2 mm. A notable improvement was obtained over Example 3 since the fabric was only very slightly singed and the bursting strength remained unchanged.

EXAMPLE 5

Example 4 was repeated with protective net PN 3. This was the same basic nylon net as PN 2 but the coating contained an accelerator and was slightly lighter than PN 2. The results with PN 3 were the same as with PN 2.

EXAMPLE 6

Example I was repeated with 9 oz./yd$^2$ navy blue RCN cotton drill in place of the battle dress. As with the battle dress, the fabric was severly charred.

EXAMPLE 7

A sample of 9 oz./yd$^2$ navy blue RCN cotton drill was subjected to an exposure intensity of 30 cal./cm$^2$ while being protected by protection net PN 5 place 5 mm in front of the fabric. PN 5 is a relatively light weight protective net. After an exposure of 1 sec. the fabric was only slightly discolored and the bursting strength was unchanged.

EXAMPLE 8

Example 7 was repeated at an exposure intensity of 20 cal/cm$^2$ with the protective net in contact with the fabric. Again the fabric was only discolored but the bursting strength was reduced by 75%.

EXAMPLE 9

Example 8 was repeated substituting a Canadian Army Summer dress fabric which was a 5 oz./yd$^2$ mixed nylon and cotton fabric, for the RCN drill. After exposure the fabric was slightly singed and the bursting strength was reduced by about ⅔.

EXAMPLE 10

A protective net PN 3, which was heavier than PN 5, was placed in contact with a 8.3 oz./yd$^2$ nylon/cotton combat cloth and subjected to thermal radiation in a solar furnace. The intensity was 30 cal/cm$^2$ and after a 1 sec. exposure the fabric was slightly singed and the bursting strength was reduced by 25%.

Tests were also conducted to determine the effectiveness of the protective nets as well as the nets together with the above fabrics in protecting bare flesh. These tests were conducted by placing a protective net or net and piece of fabric over the bare skin of the inner forearm and subjecting this to thermal radiation. Such tests are relevant to the problem of protecting normally unclothed areas such as the eye areas and the hands, for which cases the net is considered suitable.

EXAMPLE 11

A layer of protective net PN 1 was spaced 5 mm from the bare skin of the inner forearm and this was subjected to exposures of varying intensities in a solar furnace. After 1 sec. exposure at 10 cal/cm$^2$ and 15 cal./cm$^2$ the skin was slightly reddened. At a 20 cal/cm$^2$ intensity, after 1 sec. the skin was discolored and several days after the exposure slight blistering was noted.

EXAMPLE 12

A layer of protective net PN 1 and a layer of battle-dress serge or RCN cotton drill were placed in contact with the bare skin in an inner forearm and subjected to a radiation intensity of 30 cal/cm$^2$ in a solar furnace. The exposure was for 1 second and no immediate effect was noted with either combination. However, if the heated cloth was held in contact with the skin for some time slight erythema occurred.

EXAMPLE 13

A layer of protective net PN 1 and a layer of cotton-nylon combat cloth were placed on the bare skin of an inner forearm. This was subjected to an exposure intensity of 15 cal/cm$^2$ for 1 second and no effect on the skin could be noted.

These experiments have shown the the coated net is extremely effective in protecting against thermal radiation and that very little radiant energy penetrates the holes of the nets used. This would clearly indicate that most of the energy is absorbed or scattered by the smoke.

Although it is realized that a net worn over clothing might have certain disadvantages there are heavily out-weighted by its many desirable properties. As we have stated above, the coated net is very durable under intense radiation and while the smoke absorbs and scatters the heat waves so that they do not pass between the open spaces in the net, these spaces serve an essential purpose in that they provide ventilation for the person being protected with the result that heat stress due to a water-vapor impermeable layer is avoided. This is very important in clothing. Also it has been found by field tests that clothing made from the nets of this invention does not have any more tendency to snag than orthodox clothing, nor do the nets cause dizziness when used for several hours to protect the eye areas.

The above discussion has been directed exclusively to the protection of personnel, but it will be appreciated that the protective device of this invention has a much wider applicability. For example, buildings, vehicles, etc. all represent quite good forms of protection against thermal radiation but most of these have one major hazard which is the entry of radiation through windows. The coated net of this invention could be useful as screens over windows to prevent such entry of radiation.

Another use for these nets would be for the protection of ammunition and equipment which is stored in the open. Particularly when used for protecting buildings and materials, in which case a thick coating of the neoprene-tetracene mixture can be used, the protective material has the advantage that the emission of smoke ceases instantaneously with the termination of the thermal radiation and will commence again on being again subjected to radiation. This can be repeated until the fuel supply for the smoke has been exhausted. The nets tend to be self extinguishing after exposure to radiant energy, and are less likely to catch fire than normal clothing fabrics.

The embodiments of the invention in which an exclusive property or privilege is claimed are defined as follows:

1. A device for protection from thermal radiation which comprises a net coated with a mixture of neoprene and at least one explosive initiator selected from the group consisting of tetracene, lead styphnate and silver fulminate.

2. A device as claimed in claim 1 wherein the net has a base coating of neoprene containing no tetracene.

3. A device as set forth in claim 2 wherein the neoprene is in the form of a compounded neoprene cement.

4. A device as claimed in claim 1 wherein the neoprene is in the form of a compounded neoprene cement.

5. A device as claimed in claim 1 wherein the net is nylon.

6. A device as claimed in claim 1 wherein the coating is applied to only one face of the net.

7. A device as set forth in claim 2 wherein the net is nylon.

8. A device as set forth in claim 2 wherein the coating is applied to only one face of the net.

9. A device for protection from thermal radiation which comprises a nylon net coated on one face with a mixture of a compounded neoprene cement and tetracene.

10. A device for protection from thermal radiation which comprises a nylon net completely coated with a compounded neoprene cement and further coated on one face with an external layer of a mixture of compounded neoprene cement and tetracene.

11. A device as claimed in claim 10 wherein the concentration of the tetracene in the mixture is approximately 8% by weight, calculated on the solids content of the compounded cement.

* * * * *